US005372468A

United States Patent [19]

Ihle

[11] Patent Number: 5,372,468

[45] Date of Patent: Dec. 13, 1994

[54] BULK MATERIAL UNLOADING SYSTEM

[75] Inventor: Knut Ihle, Oslo, Norway

[73] Assignee: Norsk Hydro a.s., Oslo, Norway

[21] Appl. No.: 64,065

[22] PCT Filed: Sep. 25, 1991

[86] PCT No.: PCT/NO91/00122

§ 371 Date: May 18, 1993

§ 102(e) Date: May 18, 1993

[87] PCT Pub. No.: WO92/05997

PCT Pub. Date: Apr. 16, 1992

[30] Foreign Application Priority Data

Oct. 5, 1990 [NO] Norway ..... 904346

[51] Int. Cl.[5] ..... B65G 65/38

[52] U.S. Cl. ..... 414/313; 414/140.9; 414/142.2; 414/142.5; 414/327

[58] Field of Search ..... 414/142.5, 142.3, 142.2, 414/142.1, 141.2, 141.1, 140.9140.8, 313, 318, 325, 327; 198/519

[56] References Cited

U.S. PATENT DOCUMENTS

| | | | |
|---|---|---|---|
| 1,315,921 | 9/1919 | Fouchy | 414/142.5 X |
| 3,604,572 | 9/1971 | Strocker et al. | 198/519 |
| 4,474,523 | 10/1984 | Ihle | 414/142.5 |

FOREIGN PATENT DOCUMENTS

| | | | |
|---|---|---|---|
| 1343751 | 10/1962 | France . | |
| 2620154 | 11/1977 | Germany . | |
| 5-139542 | 6/1993 | Japan | 414/313 |
| 140374 | 5/1979 | Norway . | |
| 147175 | 11/1982 | Norway . | |
| 147376 | 12/1982 | Norway . | |
| 154688 | 8/1986 | Norway . | |
| 419624 | 8/1981 | Sweden . | |
| 87/06904 | 11/1987 | WIPO . | |

*Primary Examiner*—Frank E. Werner
*Assistant Examiner*—Janice L. Krizek
*Attorney, Agent, or Firm*—Wenderoth, Lind & Ponack

[57] ABSTRACT

An unloading system for transporting bulk material from a cargo hold includes parallel guides mounted to extend in a first, preferably width, direction across the top of the cargo hold. A horizontal cross bar extends across the top of the cargo hold in a second direction, preferably longitudinally, transverse to the first direction. The cross bar is mounted on the guides for movement therealong in the first direction. A scoop conveyor extends along the entire dimension of the cargo hold in the second direction and is suspended from the cross bar to be movable upwardly and downwardly relative thereto. The scoop conveyor is a single integrated conveyor member having a construction whereby it is capable of removing the bulk material in a single continuous operation from the cargo hold to a position adjacent the top of the cargo hold.

5 Claims, 3 Drawing Sheets

BULK MATERIAL UNLOADING SYSTEM

BACKGROUND OF THE INVENTION

This invention relates to unloading means for unloading bulk material from storage spaces such as cargo holds. Bulk material is material with various grain diameters such as corn, coal, fertilizer, portland cement and similar materials.

Known self unloading means for unloading of bulk material in ships employ scraper conveyors attaching the bulk material from above and moving it in one of two main horizontal directions. Due to the fact that the width of attack will be limited to the width of the individual scraper, it will also be necessary to be able to move the scraper conveyor vertically, so that it can be lowered at the same rate as the surface of the bulk material sinks due to the unloading thereof. This type of scraper conveyor is generally known from, for instance, FR Patent No. 1,343,751, but also from NO Patent No. 147,376, corresponding to U.S. Pat. No. 4,474,523, where a scraper is arranged vertically movably along one or more of the walls in the storage space.

As a result of the operation of the scraper conveyor, the bulk material will be moved in one of the horizontal directions of the hold and will be collected near one of the walls thereof, from which position the bulk material can be transported out of the hold by suitable elevator means which extends to the bottom of the hold. Known means require use of two scrapers, one in each of the main horizontal directions, and also suitable elevator means. The scraper conveyor is arranged on guide beams extending across the hold. Rails are mounted against the sidewalls of the hold to guide the scraper conveyor when the scraper conveyor is lowered at the same rate as the sinking surface of the bulk material. This arrangement requires a complicated operation and costly control system.

Another type of unloading arrangement is a system where the bulk material is unloaded from the bottom of the cargo hold. This system is known as the "Steven Adamson" system and utilizes hoppers covering and mounted to the floor of the hold. The hoppers are opened and closed by control valves. The bulk material flows through the hoppers and down to a horizontal belt conveyor transporting the material to an elevator. The drawback with this system is that auxiliary equipment has to be mounted on the hoppers to destroy or avoid bridging or clogging of the bulk material because the system will not work if the bulk material becomes clogged or bridged. Furthermore, such system is useless for unloading fluidizable material. The system works due to gravity and is dependent on use of flowable but not fluidizable bulk material. This limits the use of such unloading system.

Both of the above mentioned system, i.e. the system having two scraper conveyors and the system for unloading from the hold bottom by using hoppers, require if mounted in older ships large and costly refitting operations. The "Steven Adamson" system has therefore always been built into new ships, whereas the system for unloading from the top of the cargo requires a hold of rectangular shape adjusted to fit the scrapers. Such systems also have reduced the accessibility for inspection and maintenance during unloading.

SUMMARY OF THE INVENTION

The objects of the present invention are to eliminate the above and other prior art disadvantages and to provide a new and improved unloading system which:

- moves bulk material out from a hold in one continuous operation,
- is mounted at the top of the hold where inspection and maintenance during unloading is easy,
- can unload all types of bulk material including flowable, fluidizable and other materials.

According to the invention, these objects are achieved by use of a scoop conveyor movable along horizontal rails mounted above the cargo and below a hatch thereabove. The conveyor can travel horizontally and vertically and transports the bulk material directly out from the hold.

The unloading system according to the invention includes one longitudinal cross bar movable in the horizontal direction by wheels mounted horizontally on the rails at the top of the hold above the cargo. The scoop conveyor is suspended from the cross bar and extends along the total length of the hold. The scoop conveyor is both vertically and horizontally movable and delivers the bulk material to a transversely mounted hopper which feeds the material to a bucket elevator. The scoop conveyor travels with the cross bar horizontally sideways simultaneously as the conveyor is lowered at the same rate as the surface of the bulk material sinks or lowers. The scoop conveyor is suspended such that it can be lowered as a straight arm from the front end of the cross bar or it can be bent to include one horizontal section and one inclined section such that it is parallel to the material surface and scoops and moves the material out from the hold and up to the hopper. When the system is idle it can be hoisted to the roof and can be moved to the most suitable side of the cargo hold to allow the ship to be loaded. This system does not include any vertical guide beams mounted to the walls of the hold or any hoppers mounted in the bottom thereof. Thus, it will be very easy to convert older ships, and the system according to the invention can be modified without great expense. Maintenance also will be simple compared to previously known systems because there is no equipment mounted in the bottom of the hold. The system also will allow the hold to be used for other types of cargo than bulk material, such as containers and pallet goods.

BRIEF DESCRIPTION OF THE DRAWINGS

Additional advantages and especially important features of the invention will be apparent from the following detailed description taken with accompanying drawings, wherein.

DETAILED DESCRIPTION OF THE INVENTION

Figure 1:
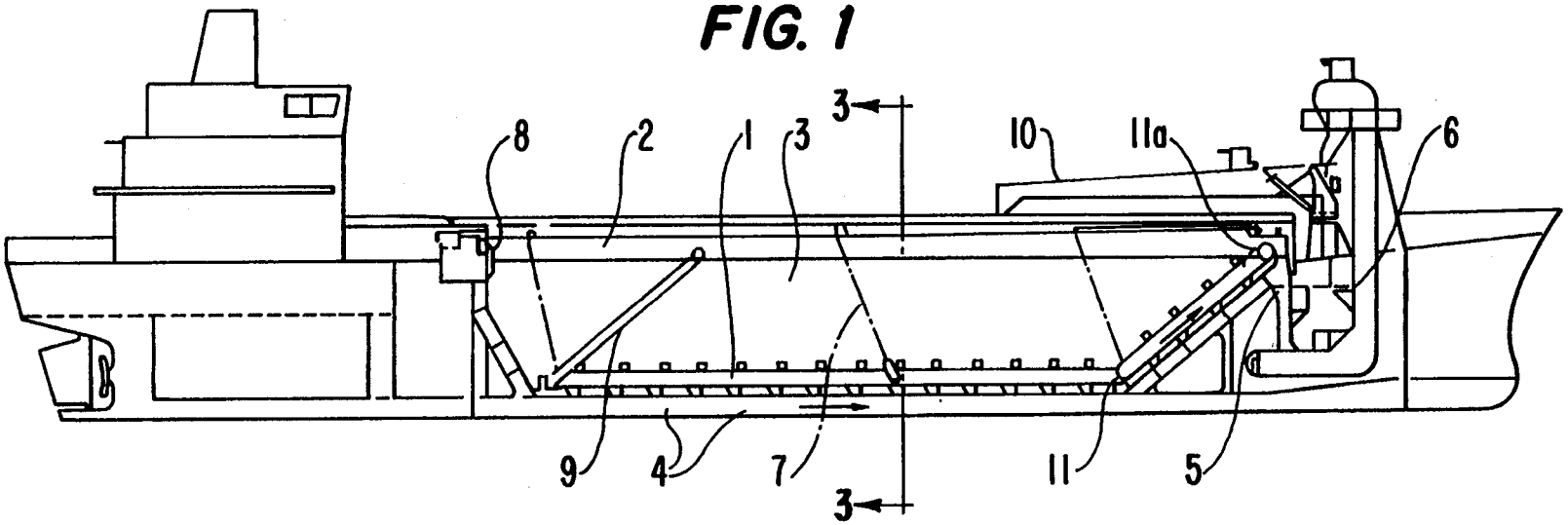
FIG. 1 is a side view of a cargo hold of a ship.
Figure 2:
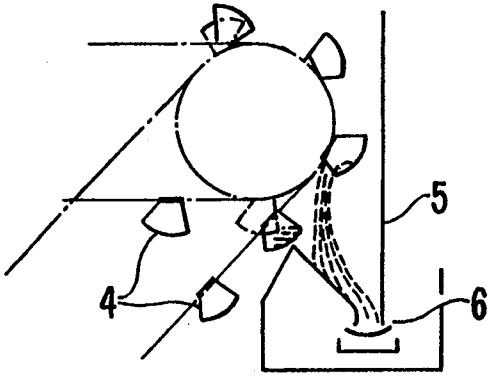
FIG. 2 is an enlarged and simplified partial view of a scoop conveyor when emptying bulk material.

An integrated scoop conveyor 1 comprises two endless or continuous chains having therebetween scoops 4 and is suspended from a horizontal, longitudinal movable cross bar 2. The scoop conveyor 1 suspended from the cross bar 2 travels therewith from side to side, whereas the conveyor 1 is regulated vertically by using, for instance, cables or wires 7 connected to a winch. A motor and gear for driving the scoop conveyor can be arranged in a box and be built into the cross bar 2 and thus will be dust free and employable for unloading of bulk material in explosive areas. The cross bar 2 is suspended from the top of two guides or rails 8 mounted on the transverse walls of a cargo hold 3 and extending thereacross. A power drive for the cross bar 2 can be positioned outside the cargo hold 3.

The scoop conveyor 1 has a hinge 11 intermediate the ends thereof and a delivery end hinged to the cross bar 2 as at 11*a*. Conveyor 1 thus can be lifted or lowered by using wires or bars. When the conveyor 1 is lowered, the total length of the conveyor can either have a constant slope or one section, from the rear to the hinge 11, can be parallel to the surface of the bulk material, whereas the remaining section of the conveyor, from the hinge 11 to the delivery end 11*a*, is inclined. The scoops 4, which are interconnected by the continuous chains and are formed as buckets, therefore transport the bulk material continuously both horizontally and vertically from the cargo hold 3 to a hopper 5. A sloped section of the hold, at the delivery end of the bulk material to the hopper 5, extends over the total width of the cargo hold. The scoop conveyor 1 can unload from a sloping or inclined orientation because the scoops 4 dig into and do not shove the bulk material. A forced movement of the material up to the next transportation means thus is obtained. A conveyor 6 transports the bulk material to a conveyor arm 10 for transportation of the bulk material onshore. This equipment is known and is not a part of the present invention. As mentioned, the scoop conveyor 1 empties at the top of the hold. Thus, the distance from the top of the roof to the bottom is large and there is space for further transport equipment for the bulk material.

Figure 3:
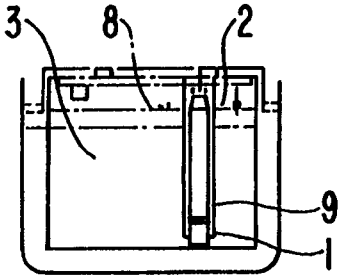
FIG. 3 is a schematic sectional view of the cargo hold of the hip, taken along line 3—3 of FIG. 1.

FIG. 3 shows scoop conveyor 1 in the lower position thereof. The guide bar 8 for guidance of the cross bar 2 extends across the width of the hold 3 for coverage of the total hold area. A rod or rods 9 brace laterally the rear end of the conveyor.

Figure 4A:
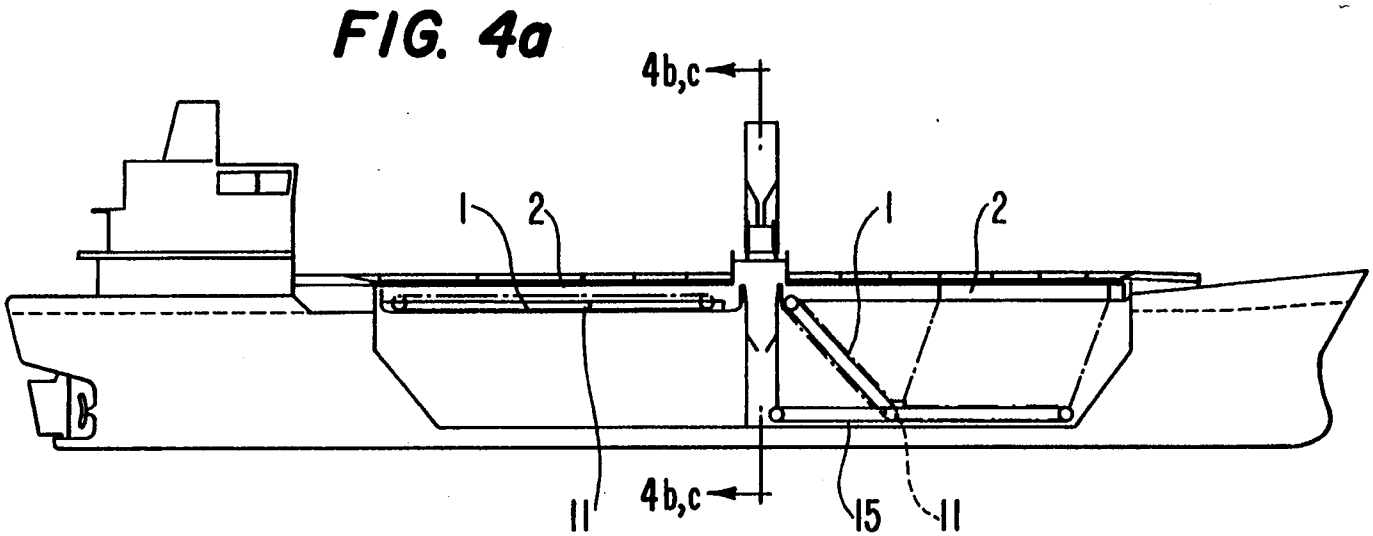
FIG. 4*a* is a view similar to FIG. 1, but showing one possible solution when the ship has two cargo holds.
Figure 5A:
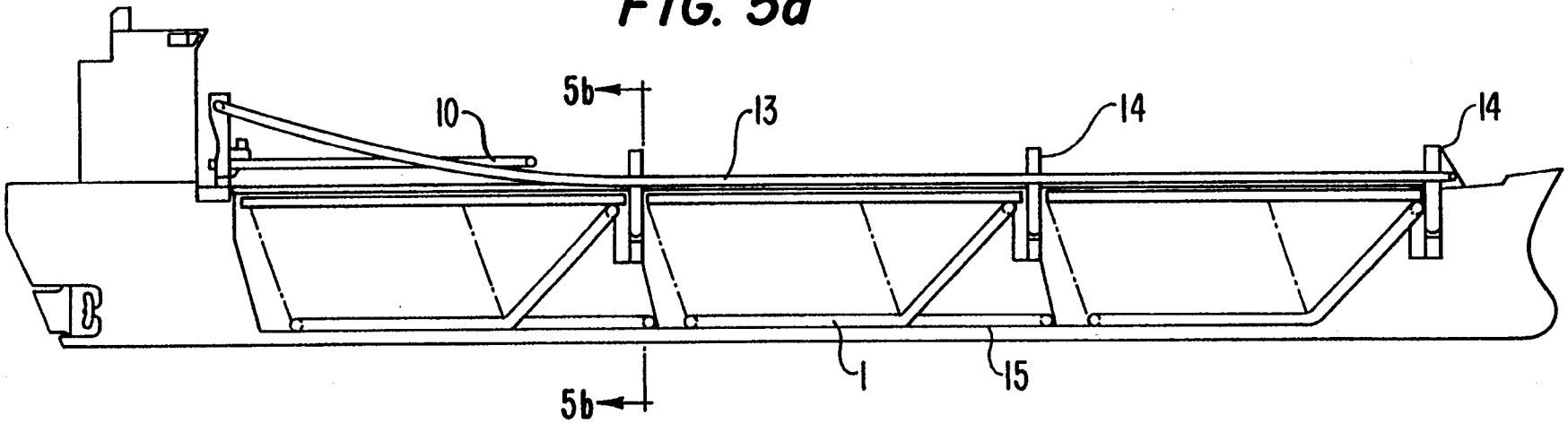
FIG. 5*a* is a view similar to FIG. 1, but showing one possible solution when the ship has three cargo holds.
Figure 5B:
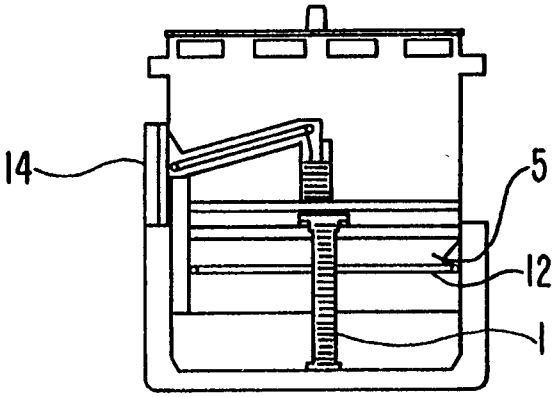
FIG. 5*b* is a sectional view of the cargo hold, taken alone line 5*b*—5*b* of FIG. 5*a*.

FIGS. 4*a* and 5*a* illustrate a ship with respectively two and three cargo holds for bulk material.

Figure 4C:
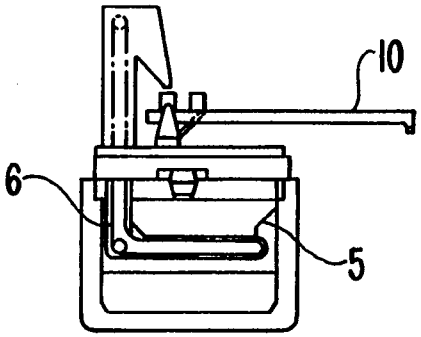
FIGS. 4*b* and 4*c* are sectional views, taken along line 4*b,c*—4*b,c* of FIG. 4*a*, for two solutions of the cargo hold.
Figure 4B:
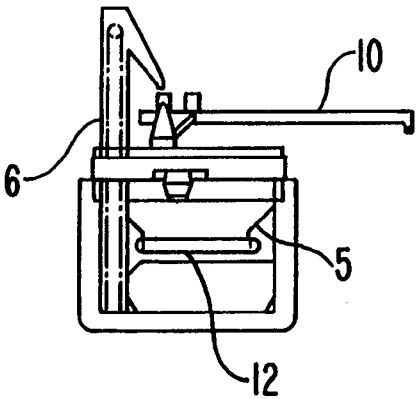

In the embodiment of FIGS. 4*a*–4*c* the conveyor arm 10 and the conveyor 6 are situated between the two cargo holds. Each of the holds has a scoop conveyor 1 feeding the bulk material towards a common hopper 5 transporting the material to, for instance, a conveyor belt 12 as shown in FIG. 4*b* or to a pocket conveyor 6 as shown in FIG. 4*c*. The conveyors 1 mounted in the holds of FIG. 8*a* are identical to the conveyor described with regard to FIG. 1, except that in addition to the scoop conveyor 1 there also may be provided a scraper conveyor 15 for that area of the hold where the scoop conveyor does not have access, e.g. due to inclination at the hopper 5. The scraper conveyor 15 can either be movable or rigidly mounted to the scoop conveyor 1 at the hinge 11.

FIG. 5*a* illustrates a ship with three cargo holds, and shows a solution where the bulk material, after being transported to a respective hopper 5 by a respective scoop conveyor 1, is moved to a respective one of three conveyor belts 12 transporting the bulk material to three bucket conveyors 14 feeding the material to a common belt conveyor 13. Belt conveyor 13 runs along the total length of a side of the ship and transports the bulk material from the bucket conveyors directly to the arm 10. Instead of using bucket conveyors 14, it is possible to use a continuous belt conveyor 13 transporting with a slope from the first hold to the conveyor arm 10. The scoop conveyors of FIG. 5*a* also are identical to that described with respect to FIG. 1, but with the same modifications regarding the scraper conveyors 15 as discussed above with regard to FIG. 4*a*.

The system according to the invention includes an integrated cross bar and scoop conveyor such that the conveyor can move horizontally and vertically and transport the bulk material up and out of the cargo hold in one continuous operation. Thus, a less expensive and high capacity system is achieved than by the known unloading system employing two scraper conveyors, one operable in each main horizontal direction. The system of the invention is very easy to fit in and remove from ships because no vertical guide bars mounted to the side walls or modifications of the bottom is needed. This simplifies the mounting, inspection and maintenance of the system. The system is equipped with scoops that dig and carry the bulk material, and can therefore unload fluid and cloggable bulk material. The system therefore is very adaptable and flexible.

I claim:

1. An unloading system for transporting bulk material from a cargo hold, said system comprising:

parallel guides mounted to extend in a first direction at the top of the cargo hold;

a horizontal cross bar extending across the top of the cargo hold in a second direction transverse to said first direction, said cross bar being mounted on said guides for movement therealong in said first direction;

a scoop conveyor extending along the entire dimension of said cargo hold in said second direction;

suspension devices suspending said scoop conveyor from said cross bar and enabling said scoop conveyor to be lowered from said cross bar to bulk material within the cargo hold and to be lifted from the bulk material to said cross bar; and said scoop conveyor comprising a single conveyor member having an integrated construction enabling said conveyor member to remove the bulk material in a single continuous operation from within the cargo hold to a discharge position adjacent the top thereof by movement of the bulk material generally horizontally within the cargo hold and then by movement of the bulk material upwardly from the cargo hold to said discharge position.

2. A system as claimed in claim 1, wherein said scoop conveyor has a delivery end hinged to said cross bar.

3. A system as claimed in claim 2, wherein said conveyor member comprises first and second length sections hinged together at a hinge.

4. A system as claimed in claim 3, wherein said suspension devices are connected to said first and second length sections and enable said first length section to pivot at said delivery end relative to said cross bar and enable said second length section to pivot at said hinge relative to said first length section.

5. A system as claimed in claim 1, further comprising a hopper positioned adjacent the top of the cargo hold, and said conveyor member conveys the bulk material upwardly at an inclination from the cargo hold to said hopper.

* * * * *